US008505315B2

(12) United States Patent
Kasza et al.

(10) Patent No.: US 8,505,315 B2
(45) Date of Patent: Aug. 13, 2013

(54) ENHANCED INTEGRATED OPERATION BLENDER BASED STERILE MEDICAL ICE SLURRY PRODUCTION DEVICE

(75) Inventors: Kenneth E. Kasza, Palos Park, IL (US); Farah J. Shareef, Lombard, IL (US); Brandon L. Fisher, Plainfield, IL (US)

(73) Assignee: UChicago Argonne, LLC, Chicago, IL (US)

( * ) Notice: Subject to any disclaimer, the term of this patent is extended or adjusted under 35 U.S.C. 154(b) by 1030 days.

(21) Appl. No.: 12/367,362

(22) Filed: Feb. 6, 2009

(65) Prior Publication Data

US 2009/0255276 A1 Oct. 15, 2009

Related U.S. Application Data

(60) Provisional application No. 61/045,083, filed on Apr. 15, 2008.

(51) Int. Cl.
*F25C 1/00* (2006.01)

(52) U.S. Cl.
USPC ..... 62/68; 62/342; 62/343; 606/44

(58) Field of Classification Search
USPC ..... 62/330, 76, 343, 68, 233, 201, 342; 606/44, 233
See application file for complete search history.

(56) References Cited

U.S. PATENT DOCUMENTS

| | | | | | |
|---|---|---|---|---|---|
| 3,319,436 | A * | 5/1967 | Wilch | 62/68 |
| 4,249,388 | A * | 2/1981 | Burns | 62/185 |
| 5,005,364 | A * | 4/1991 | Nelson | 62/76 |
| 5,839,287 | A * | 11/1998 | Stormo | 62/89 |
| 5,902,299 | A * | 5/1999 | Jayaraman | 606/20 |
| 6,244,052 | B1 | 6/2001 | Kasza | |
| 6,413,444 | B1 | 7/2002 | Kasza | |
| 6,547,811 | B1 | 4/2003 | Becker et al. | |
| 7,118,591 | B2 | 10/2006 | Frank et al. | |
| 7,603,868 | B2 * | 10/2009 | Sveinsson | 62/76 |
| 2004/0027912 | A1 * | 2/2004 | Bibbo et al. | 366/149 |
| 2006/0036302 | A1 | 2/2006 | Kasza et al. | |
| 2007/0056313 | A1 | 3/2007 | Kasza et al. | |

* cited by examiner

*Primary Examiner* — Frantz Jules
*Assistant Examiner* — Alexandro Acevedo Torres
(74) *Attorney, Agent, or Firm* — Joan Pennington

(57) ABSTRACT

A method and device are provided for the preparation of sterile medical ice slurry, for example having ice loadings of greater than approximately 50%. An integrated-operation ice slurry blender-based production and delivery system methods for monitoring cooling capacity of the produced and delivered slurry. All individual medical ice slurry production and delivery steps are integrated into one tightly coupled precisely sequenced and timed system. The novel procedure and equipment is simple to use and makes sterile slurry, which is ready to deliver to patients, for example, in less than 2 minutes after adding predetermined thermally preconditioned ingredient modules to a blender.

18 Claims, 2 Drawing Sheets

ENHANCED INTEGRATED OPERATION BLENDER BASED STERILE MEDICAL ICE SLURRY PRODUCTION DEVICE

This application claims the benefit of U.S. Provisional Application No. 61/045,083 filed on Apr. 15, 2008.

CONTRACTUAL ORIGIN OF THE INVENTION

The United States Government has rights in this invention pursuant to Contract No. W-31-109-ENG-38 between the United States Government and The University of Chicago and/or pursuant to Contract No. DE-AC02-06CH11357 between the United States Government and UChicago Argonne, LLC representing Argonne National Laboratory.

FIELD OF THE INVENTION

The present invention relates to a method for the preparation of ice slurry. More specifically this invention relates to a method for the preparation of sterile medical ice slurry composed of micro-sized ice particles immersed in biologically compatible liquid carrier. The slurry can also be a carrier for other cell health beneficial chemicals or gases. Still more specifically this invention relates to an improved method and apparatus for the preparation of sterile medical ice slurry having ice loadings of greater than approximately 50% that is deliverable with out plugging through a variety of small diameter specially designed for slurry delivery tubes inserted inside the body for inducing targeted protective cooling.

DESCRIPTION OF THE RELATED ART

Various studies have proven that the induction of hypothermia reduces cell damage due to oxygen deficiencies resulting from decreased or no blood flow to critical organs or due to tissue impact trauma or surgical insults. Cooling of cells, inducement of therapeutic hypothermia diminishes their metabolic demand for oxygen over extended time periods and reduces cell apoptosis caused by ischemia or reperfusion insults and tissue trauma. Slurry cooling also holds promise of inducing neurological protection of the brain and spine.

The use of therapeutic hypothermia has the potential for becoming a key factor in the treatment of emergency medical events such as cardiac arrest, myocardial infarction, hemorrhagic shock, and stroke, which are characterized by obstructed blood flow to the heart and brain. The use of therapeutic hypothermia also has the potential for protecting cells and tissue during several types of surgery such as laparoscopic, cardiac/cardiovascular and for various robotic procedures where targeted delivery of slurry for protection can be advantageous. Additionally slurry induced hypothermia has potential for protecting a variety of organs during harvesting and transplantation.

Conventional cooling methods presently used to induce hypothermia include: 1) external bypass heat exchangers that are feasible for use only in a hospital because of complexity and are slow to implement and, 2) external cooling through the use of ice packs, cooling blankets, and the like, which cool the body core very slowly and because of whole body cool down can cause secondary detrimental side effects such as shivering and vasculature constriction. Through the use of these methods, the core temperature of the body can only be decreased by 0.03° C./min, which results in less than 1° C. of cooling in 15 minutes. It is believed that, depending on medical application; 4 to 15° C. of rapid cooling (<15 minutes) is needed to induce therapeutic hypothermia in many applications. Ice slurry cooling allows targeted rapid highly controlled cooling of a specific organ or group of organs and in most cases avoids shivering and allows multiple targets to be protectively cooled to optimum individually protective temperatures. Targeted slurry cooling also has potential for replacing the use of bypass cooling machines during some surgeries, such as cardiac and cardiovascular.

Ice slurry cooling technology was originally developed by ANL for use in industrial or building cooling. At Argonne National Laboratory pioneering work has been performed in the development of slurry production and delivery equipment and in exploring slurry cooling applications for a variety of medical cooling applications.

For example, U.S. Pat. No. 6,244,052 by Kenneth E. Kasza issued Jun. 12, 2001, and entitled "Method and Apparatus for Producing Phase Change Ice Particulate Perfluorocarbon Slurries" discloses a phase change ice particulate perfluorocarbon slurry and a method and apparatus for producing phase change particulate perfluorocarbon slurries. A known amount of perfluorocarbon liquid is provided. A set percentage of a phase change liquid and optionally other additives, such as oxygen or other cell protectants are added to the known amount of perfluorocarbon liquid. The phase change liquid and the perfluorocarbon liquid are mixed to produce an emulsion of small droplets of the phase change liquid in the perfluorocarbon liquid. The emulsion is cooled to produce the phase change particulate perfluorocarbon slurry. A phase change ice particulate perfluorocarbon slurry comprises a known amount of perfluorocarbon liquid and a set percentage of a phase change liquid added to the known amount of perfluorocarbon liquid. An emulsion is formed by the set percentage of a phase change liquid and the known amount of perfluorocarbon liquid. The phase change particulate perfluorocarbon slurry is formed by cooling the emulsion to a freezing point. The phase change liquid includes water or a saline solution. A set percentage of water is provided in a range between about 5% and 50%. A set percentage of saline solution is provided in a range between about 0.5% and 6.0%.

U.S. Pat. No. 6,413,444 by Kenneth E. Kasza issued Jul. 2, 2002, and entitled "Methods and Apparatus for Producing Phase Change Ice Particulate Saline Slurries" discloses a phase change particulate saline slurry and methods and apparatus for producing phase change particulate saline slurries. One method for producing phase change particulate saline slurries includes the steps of providing a liquid with a set percentage freezing point depressant, such as, a set percentage saline solution; subcooling the saline solution to a freezing point to produce ice particles; and increasing an ice particle concentration under controlled temperature for a period of time to provide a set ice particle concentration for the phase change particulate saline slurry. In another method for producing phase change particulate saline slurries, water and a first set amount of sodium chloride are provided to produce a saline solution. The saline solution is cooled to a set temperature. A selected percentage of chunk ice is added to the saline solution and the chunk ice is broken into ice particles. The ice particles have a small size. Next a second set amount of sodium chloride is added and distributed for smoothing of the ice particles. The total saline solution concentrations resulting from the total of the first set amount and the second set amount of added sodium chloride are preferably in the range of about 0.5% to 6.0%. The loadings or percentage of ice particles are preferably in the range of 5% to 50%. A phase change particulate saline slurry includes a water and sodium chloride solution. The sodium chloride is provided in a range between about 0.5% to 6.0%. A percentage of ice particles is provided in the range between about 5% to 50%. The ice particles have a size of about 1 mm or less than 1 mm (depending on production procedures); and the ice particles have a generally smooth globular shape.

U.S. Pat. No. 6,547,811 by Lance B. Becker, Terry Vanden Hoek, and Kenneth E. Kasza issued Jul. 2, 2002, and entitled "Method for Inducing Hypothermia" discloses systems for phase-change particulate slurry cooling equipment and methods to induce hypothermia in a patient through internal and external cooling. Subcutaneous, intravascular, intraperitoneal, gastrointestinal, and lung methods of cooling are carried out using saline ice slurries or other phase-change slurries compatible with human tissue. Perfluorocarbon slurries or other slurry types compatible with human tissue are used for pulmonary cooling. Traditional external cooling methods are improved by utilizing phase-change slurry materials in cooling caps and torso blankets.

U.S. Patent Publication 2007/0056313 Al published Mar. 15, 2007, U.S. Ser. No. 11/229,060, filed Sep. 15, 2005, by Kenneth E. Kasza et al., discloses an apparatus for producing sterile ice slurries for medical cooling applications. The apparatus is capable of producing highly loaded slurries suitable for delivery to targeted internal organs of a patient, such as the brain, heart, lungs, stomach, kidneys, pancreas, and others, through medical size diameter tubing. The ice slurry production apparatus includes a slurry production reservoir adapted to contain a volume of a saline solution, or other solution containing a freezing point depressant. A flexible membrane crystallization surface is provided within the slurry production reservoir. The crystallization surface is chilled to a temperature below a freezing point of the saline solution (or other types of solutions) within the reservoir such that ice particles form on the crystallization surface. A deflector in the form of a reciprocating member is provided for periodically distorting the crystallization surface and dislodging the ice particles, which form on the crystallization surface. Using reservoir mixing the slurry is conditioned for easy pumping directly out of the production reservoir via medical tubing or delivery through other means such as squeeze bottles, squeeze bags, hypodermic syringes, manual hand delivery, and the like.

U.S. Patent Publication 2006/0036302 A1 published Feb. 16, 2006, U.S. Ser. No. 11/140,500, filed May 27, 2005, by Kenneth E. Kasza et al., discloses methods of inducing protective hypothermia of an organ that include delivering a phase-change particulate slurry to at least a portion of the organ, for example under minimally invasive laparoscopic surgical procedures; and reducing a temperature of the organ through heat exchange with the phase-change particulate slurry. Therapeutically acceptable levels of protective cooling were induced in animal kidneys, which protected them from ischemia well beyond 90 minutes; in comparison to only 30 minutes of time for a surgery without cooling conducted at normal body temperature.

U.S. Pat. No. 7,118,591 issued Oct. 10, 2006, by Frank et al., discloses a medical probe comprising an insert able small heat exchanger that can be used to induce localized cooling of tissue, including the brain and other tissue or organs, and monitor the health of samples such as the brain while providing local cooling or heating. A heat transfer probe includes an inner channel, a tip, a concentric outer channel, a first temperature sensor, and a second temperature sensor. The inner channel is configured to transport working fluid from an inner inlet to an inner outlet. The tip is configured to receive at least a portion of the working fluid from the inner outlet. The concentric outer channel is configured to transport the working fluid from the inner outlet to an outer outlet. The first temperature sensor is coupled to the tip, and the second temperature sensor spaced apart from the first temperature sensor. Working fluid (coolant) from a source is transported through the inner channel of the probe to change a temperature of tissue adjacent the probe together with transporting the working fluid through the concentric outer channel of the probe back to the source; sensing a first temperature of the tissue at a first location using a first temperature sensor coupled to the probe; and sensing a second temperature of the tissue at a second location using a second temperature sensor spaced apart from the first temperature sensor. The difference between the first and second temperatures is used to determine a thermal property of the tissue; comparing the first and second temperatures; and calculating a thermal transport property of the tissue based on the comparison.

Principal aspects of the present invention are to provide an enhanced method and device (integrated system) for the preparation and delivery of sterile medical ice slurry, for example, having ice loadings of greater than approximately 50%.

Important aspects of the present invention are to provide such method and device for the preparation of sterile medical ice slurry substantially without negative effect and that overcome some of the disadvantages of prior art arrangements.

SUMMARY OF THE INVENTION

In brief, a method and device are provided for the preparation of sterile medical ice slurry, for example having ice loadings of greater than approximately 50%.

An integrated-operation ice slurry blender-based production and delivery system of the invention includes methods for monitoring cooling capacity of the produced and delivered slurry. All individual medical ice slurry production and delivery steps are integrated into one tightly coupled system.

In accordance with features of the invention, the novel process eliminates transferring slurry into additional containers for conditioning and pumping. Blender ingredients preparation procedures provide improved capability for making medical sterile slurry from sterile ingredients contained in separate modules and enable quick and reliable delivery of sterile slurry at greater than approximately 50% ice loading. All steps in producing a highly loaded ice particle slurry are carefully engineered, interfaced, and timed to maximize ice particle smoothing to allow achieving high ice particle loadings and a slurry that can be delivered without plugging through small diameter specially designed delivery tubes and injector tips.

In accordance with features of the invention, the novel procedure and equipment is simple to use and makes sterile slurry, which is ready to deliver to patients, for example, in less than 2 minutes after adding predetermined preconditioned ingredient modules to a specialized blender system.

In accordance with features of the invention, the blender includes: a thermally insulating blender container, a slurry conditioning-agitator mechanical mechanism used to enhance slurry early stage mixing and to suppress air entrainment into the slurry, and an outlet port for pumping slurry out of the container using a slurry delivery tubing pump coupled by a slurry delivery tube to the outlet port located on a lower portion of the blender container with an associated specially designed slurry injector tip connected to the discharge end of a pump tube. A variable electric power transformer is used to control blender speed and cycle blender operation through two carefully timed stages during slurry production. At least one thermocouple is mounted inside the blender container for recording temperature during the slurry production and delivery which allows real time assessment of slurry ice loading and determination of when desired ice loading is achieved.

The tubing pump through calibration allows the setting of slurry delivery rate and also tracts amount delivered both of which facilitate reaching a targeted protective cooling temperature.

In accordance with features of the invention, a plurality of preconditioned slurry modules containing sterile pre-measured ingredients; (one slurry recipe includes one ingredient module containing large ice chunks and the second containing water plus freezing point depressants such as salt used to achieve ice particle smoothing during production) which are added to the blender with the variable electric power transformer set at 0%. Then precisely timed ice chopping is started with the variable electric power transformer set at 100%, and a slurry conditioning mechanical agitation device is initiated by being moved up and down within the blender container to enhance mixing and control air entrainment in the slurry. The chopping process continues for a set time period, and then slurry conditioning and mixing phase (no additional ice chopping takes place) is performed with the variable electric power transformer set, for example, at 50%. Then direct slurry pumping from the blender container or vessel is implemented by activating the slurry delivery tubing pump.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

In accordance with features of the invention, improved ice slurry coolant production and delivery are provided through the integration and streamlining of the separate steps of an ice slurry production method. The improvements are achieved using a better understanding of the influence of the many parameters and phenomena involved in the ice slurry production process.

Figure 1:
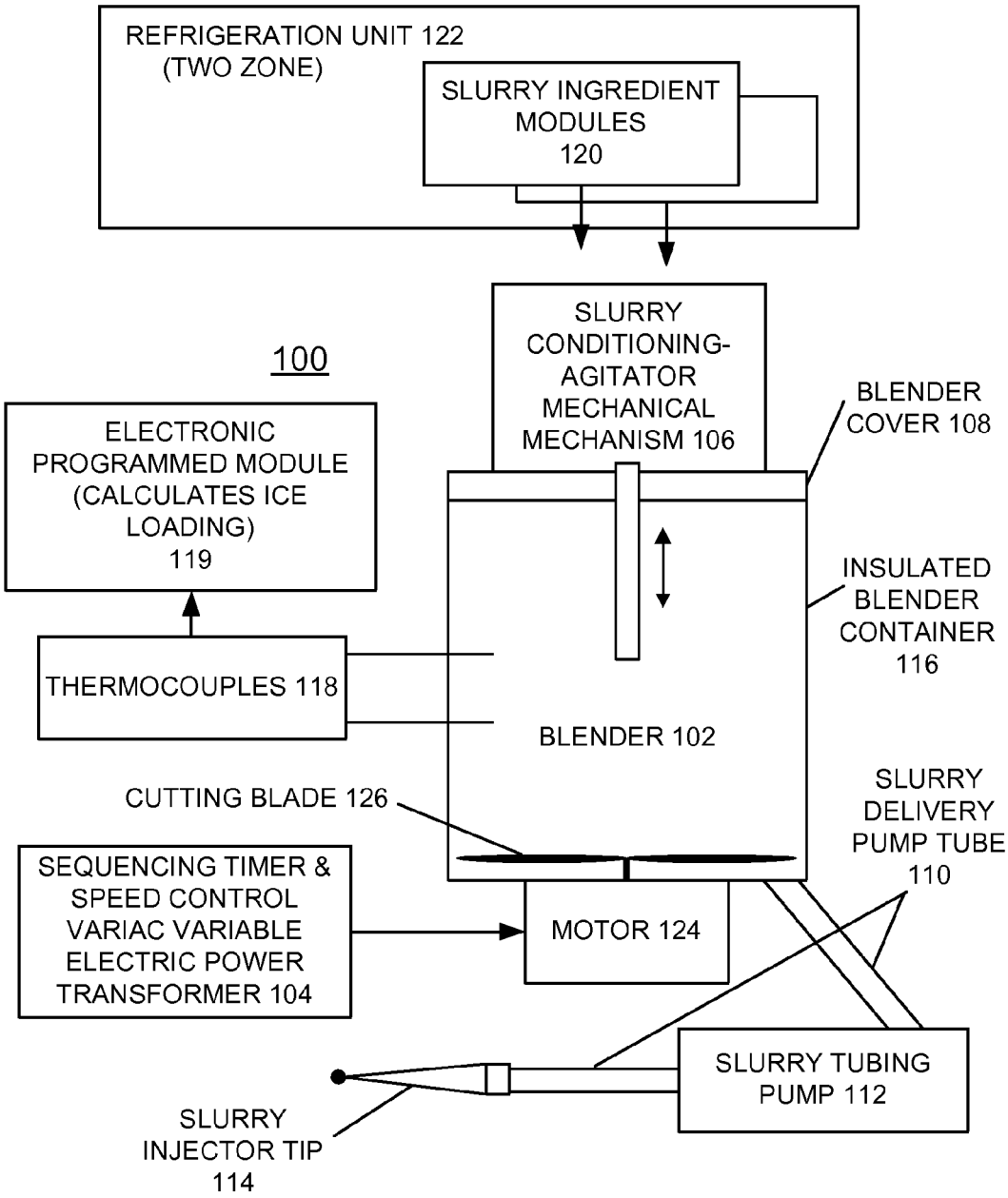
FIG. 1 is a schematic and block diagram illustrating an exemplary integrated production and delivery system for sterile medical ice slurry in accordance with the preferred embodiment.

Having reference now to the drawings, in FIG. 1 there is shown an exemplary integrated slurry production and delivery system generally designated by the reference character 100 having capability for implementing the preparation of sterile medical ice slurry having ice loadings of greater than or approximately equal to 50% in accordance with the preferred embodiment.

In accordance with features of the invention, as shown in FIG. 1, the slurry production and delivery system 100 enables integration and streamlining of the separate steps of an ice slurry production method with this single integrated production and delivery system that can easily be used in a sterile medical environment. In addition, the new procedure reliably produces ice slurry having ice loadings approaching 50% by weight which can be delivered through very small diameter long properly designed medical tubing to a target, as compared to typical 20-25% from conventional equipment which tends to plug the delivery system and can also be difficult to remove from a storage reservoir. The new equipment of system 100 of the invention allows production of ready to use slurry in less than 2 minutes; the previous system required more than 15 minutes of preparation time. Furthermore, the greatly reduced need for human intervention, other than to initially add the sterile ingredients contained in modules to the blender, start the blender and pump, and operate the slurry conditioning-agitator mechanical mechanism, has made the new method of slurry production and delivery much easier to use and maintain medical sterility, much more reliable, and capable of producing slurry of consistent high ice loading and handling characteristics.

In accordance with features of the invention, a fully developed commercial slurry production and delivery system 100 includes a blender based equipment for producing and delivering the slurry including a blender 102 with a sequencing timer speed control variac variable electric power transformer 104 operatively controlling the blender 102. The sequencing timer variable electric power transformer 104 is used to control blender speed and cycle blender operation through two time stages during slurry production.

A slurry conditioning-agitator mechanical mechanism 106 of the invention is provided or assembled with a blender cover 108 and is moved up and down within the blender 102 to enhance mixing, controlling air entrainment in the slurry during an ice chopping stage of the slurry production. A slurry delivery tube 110, such as a silicone delivery tube, is coupled to a blender outlet port and a slurry tubing pump 112 with an associated injector tip 114 specific to a particular medical cooling application. The blender 102 includes a thermally insulating blender container 116. At least one thermocouple 118 is mounted inside the blender container for recording temperature during the slurry production and delivery. Methods for monitoring cooling capacity of the produced and delivered slurry use the measured temperature of thermocouple 118 which is interfaced with an electronic programmed module 119 for calculating slurry ice loading based on slurry temperature and readout displaying ice loading.

System 100 includes a plurality of disposable slurry modules 120 containing the sterile ingredients for producing slurry, such as ice and saline solution; or alternatively additional ingredients (chemicals and/or gases) promoting cell health. A refrigeration unit 122, such as a two zone unit, is used for thermally preconditioning the ingredient modules 120. A motor 124 operatively controlled by sequencing timer speed control variac variable electric power transformer 104 drives a cutting blade 126 contained within the blender 102.

Figure 2:
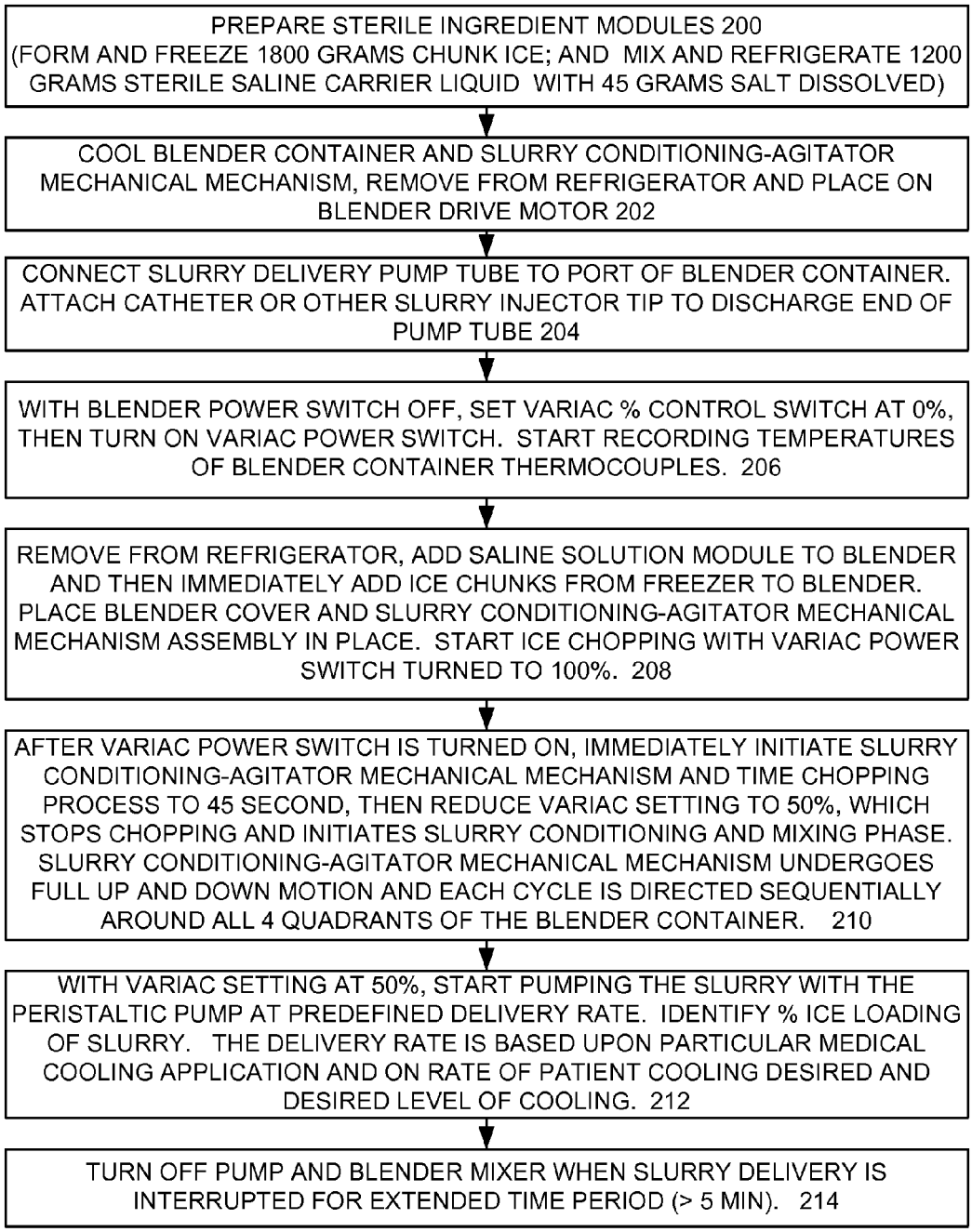
FIG. 2 is a flow chart illustrating exemplary sequential operations of the integrated production and delivery system of FIG. 1 in accordance with the preferred embodiment.

The blender 102 is implemented with a commercial heavy duty blender that has been modified in accordance with the preferred embodiment in six important ways which allows integration with other equipment resulting in reliable production and delivery of slurry with minimal human intervention. The new integrated ice slurry production and delivery system 100 includes the following equipment, ingredients, and general use protocol, as shown in FIG. 1 performing the method as illustrated in FIG. 2.

The sequencing timer controlled variac variable electric power transformer 104 is used to control blender speed and cycle the blender 102 sequentially through two stages during slurry production, which are critically, timed operations of ice chopping and slurry conditioning and mixing. Slurry conditioning/mixing is performed at a much lower blender cutting blade speed than ice chopping. The revolutions per minute of the blender blades are controlled by the variac variable electric power transformer 104 to ensure optimal chopping directed at achieving very small ice particle size without excessive reduction in slurry ice loading resulting from blender mechanical dissipation heat generation induced ice melting. The duration of high speed chopping cycle is also limited in duration to make optimal use of the freezing point depressant (salt) added to the carrier liquid for smoothing of the ice particles. Chopping the ice too long uses up the smoothing capability from the available salt and creates additional ice particles that have rough surfaces and are not smoothed which greatly reduces slurry fluidity and promotes delivery tube/conduit/injector tip plugging. As a consequence of the preceding phenomena, all steps in slurry production are carefully timed and the timing is precisely related to the ingredients added to the blender 102 including salt concentration, carrier liquid-type/amount, temperature of ingredients, and initial amount and temperature of ice loaded of the preconditioned slurry ingredient modules 120.

A device called the slurry conditioning-agitator mechanical mechanism 106 of the preferred embodiment is installed in the top cover 108 of the blender 102 which is used to greatly improve the mixing of the ice particles and ice chunks and the carrier liquid modules 120 added to the blender 102 during the initial ice chopping period by eliminating blender loss of mixing resulting otherwise from cavitations around the blender cutter blade. The slurry conditioning-agitator mechanical mechanism 106 is also used to suppress the formation of an air entraining vortex in the blender container 116, which is produced by the blender cutting blade. To suppress vortex formation the slurry conditioning-agitator mechanical mechanism 106 is positioned directly on a central vertical axis of the container 116 and extends into the core of the vortex blocking air entrainment. Reducing or controlling air entrainment into the slurry is important especially for slurry being delivered into the blood stream. The slurry conditioning-agitator mechanical mechanism 106 is used in the early stages of ice chopping and is moved up and down by a mechanical mechanism or a user operator to enhance mixing.

Three different methods of the invention have been developed for quantifying % ice loading of the ice slurry during production and delivery, one of which uses slurry temperature data as measured by one or more thermocouples 118 mounted inside the blender container 116.

Once production and conditioning of the ice slurry coolant is completed in the blender 102, the slurry is delivered using a peristaltic tubing pump 112. Direct slurry pumping from the blender container 116 is implemented by installing an outlet port on the lower portion of the blender container 116 to which a medical grade silicone pump tube 110 is connected. The tube 110 is routed through, for example, a Masterflex tubing pump used for slurry tubing pump 112, to allow pumped slurry delivery through the slurry injector tip 114 connected to the outlet end of pump tubing 110. Various injector tips are known for different medical applications.

The blender container 116 is heavily insulated to reduce heat gain from the ambient. Heat gain manifests itself by reducing the ice loading of the delivered slurry. Heat gain is very important when the slurry is made but not used quickly or is delivered at a slow rate over a long period of time. Optionally, active cooling may be added to the blender container design to enhance long term maintenance of the slurry or the blender container can be designed to include a double wall with the space between comprising a vacuum.

Two sterile slurry ingredient modules 120, for example, saline solution and ice chunk modules, and a two zone thermal preconditioning refrigerator 122 are provided for use in making ice slurry with the blender method of the invention. As an example, one zone comprising a freezer for the formation of ice chunks and the second zone for prechilling the saline and the formed ice chunks to approximately 0° C.

Operational Protocol for New Integrated-Operation Slurry Production System 100

An exemplary description follows describing in detail the preparation of the ingredients for making a three liter batch of saline base slurry, its production, and then pumped delivery using the new integrated-operation slurry production system. These detailed procedures were used to conduct experiments on slurry production/delivery and generate an improved understanding of the parameters and phenomena influencing slurry production, improve the equipment, and generate the slurry production performance characterization data presented below in the following.

The slurry described below utilizes a saline solution based ice particle carrier liquid with the salt also used to induce ice particle chemical smoothing. It should be understood that the present invention is not limited to producing saline based ice particle slurry; for example other cell health enhancing chemicals and or gases could be part of the ingredients.

Preparation of Slurry Ingredients (Reference Slurry Recipe):

Two types of sterile ingredient modules are needed for making a saline based ice slurry with the blender method. In their most basic form the modules contain: a) Sterile saline solution carrier liquid (plus additional chemicals depending on slurry application); b) Sterile water for making the large ice chunks for the blender. Additional salt or salts can be added to the saline or more or less ice chunks can also be added if additional chemical smoothing or if other ice loading are required for a specific cooling application. The actual ingredients (type and amount) used and the values of processing parameters employed during slurry production and conditioning have a direct influence on slurry ice delivered loading and on the ability to deliver the slurry through small diameter medical injector tips without plugging and also dictate actual slurry temperature.

Advanced types of slurries such as those in which it is beneficial to have additional cell conditioning chemicals or gases would have these ingredients incorporated in the sterile modules.

The sealed sterile ingredient modules 120 contain the correct quantities to make one batch or one unit volume of slurry. The equipment of system 100, for example, is used to make a three liter batch of ice slurry, which typically requires 1800 grams of chunk ice and 1200 grams of sterile water carrier liquid containing 45 grams of NaCl (salt). The slurry ingredient modules 120 contain the appropriate chemicals and water for making one batch of slurry and consist of sealed sterile plastic bags similar to those currently used for commercial drip bag saline (0.9% by weight. NaCl). Similarly the modules 120 for making the ice chunks contain sterile water in plastic trays resembling ice cube trays sold with the top sealed with plastic. After freezing, the tray is twisted and the seal broken allowing the ice chunks to be added to the blender container. Sterile ingredient module thermal preconditioning prior to making slurry is accomplished by the use of a two compartment refrigeration unit 122 having different temperature settings; one for ice chunk production and the second for carrier liquid thermal conditioning. In general, multiple modules of each type would be stored in the refrigeration for later use in slurry production and delivery.

The following procedures have been used for preparing the saline solutions and ice cube chunks used in developing and quantifying performance of the new equipment of system 100.

Referring also to FIG. 2, there are shown exemplary sequential time operations of the integrated production and delivery system 100 of FIG. 1 in accordance with the preferred embodiment. First sterile ingredient modules 120 are prepared as indicated at a block 200. (The following saline and ice production steps in a future commercially procured system would not be performed by the operator; the operator would only refrigerate the procured modules for thermal preconditioning and then add the ingredient modules to the blender.)

Preparation of Saline Solution

The steps involved in preparing saline solution carrier liquid are:

1. Place 1200 grams of pure sterile water and 45 grams of high purity medical grade Fisher crystal salt into a 2 liter sterile plastic bottle.
2. Close the bottle cap and vigorously shake the solution until all the salt has dissolved.
3. Store the saline solution in the dual zone refrigerator/freezer with the refrigerator zone set at approximately 0° C.

Preparation of Ice Chunks

In experiments, two types of ice chunks were evaluated as ingredients for making slurry in the blender: ½ sphere and cube shaped ice chunks. The use of sealed cube trays sold as ingredient modules facilitates maintaining sterility of the slurry ingredients and ensuring that the correct amount of ice chunks is used for each batch of slurry. Both types of ice chunks were made in plastic trays, which were placed in the freezer compartment. As an alternative, a medical grade automatic ice cube maker could be used to produce ice from medical grade pure sterile water and store it ready to be used when slurry production is desired.

The procedures for making the two types of ice chunks are identical; the steps for making the ½ sphere cubes are:

1. Fill the sterile trays with pure sterile water to the fill line and then seal with the screw cap (a 3 liter batch of slurry using the reference recipe requires 1800 grams of ice).
2 Place the trays horizontally in the freezer compartment with the temperature set between −1° C. and −25° C.
3. When the ice has formed and is needed for slurry production both ends of a tray are twisted in opposite directions releasing the ice chunks which are then, after first adding the conditioned saline, added directly into the blender.

Below are listed some important properties of the reference recipe for a 3 liter batch of saline slurry:

a) Reference Slurry Recipe ingredients:

3045 g batch (~3 liter batch)=1800 g ice+1200 g pure $H_2O$+45 g salt.

b) Salinity Range:

Initial before any ice melts from production process=45 g NaCl/1245 g sol.=3.61%

Final after all ice has melted in a cooling application=45 g NaCl/3045 g Slurry=1.48% c) Saline Equilibrium Freezing Point Depression Range (for reference recipe):

Initial=−2.17° C.; Final=−0.88° C.

(Based on Concentrative properties of Aqueous Solutions: Conversion Table by A. V. Wolf, Morden G. Brown, Phoebe G. Prentiss in the CRC Handbook of Chemistry and Physics (editors: R. C. Weast and M. J. Astle), 62, D-353-354.)

d) As shown by the above slurry salinity properties, the salinity of an ice chunk saline solution slurry mixture is characterized or bounded by a unique pair of equilibrium temperatures which for the reference recipe described here ranges initially when the ingredients are added to the blender from −2.17° C. to −0.88° C. when all the ice comprising the slurry as melted. Knowing the temperature of the well mixed slurry as it changes during the production and delivery process allows us to track the amount of ice present in the slurry mixture and is one of the best of three methods of the invention for accomplishing this as described below in the following.

Laboratory Slurry Production Protocol

The following describes the detailed use of the slurry production and delivery equipment 100 for making 3 liters of slurry using the reference recipe ingredient modules described above. The protocol is as follows:

1. Cool the blender container 116 and slurry conditioning-agitator mechanical mechanism 106 as indicated at a block 202, for example, by placing them in the refrigerator used for the saline solution thermal conditioning for 30 minutes. The slurry conditioning-agitator mechanical mechanism 106 is not sealed in the insulated blender container 116 for this step in order to speed up cool down. Cooling this equipment including the slurry conditioning-agitator mechanical mechanism 106, cover 108 and blender container 116, prior to slurry production minimizes parasitic heat gains which lead to a reduction in the % ice loading of the ice slurry coolant produced. (This step could be eliminated by making the blender container chillable by circulating a coolant through a double wall designed container; this would also provide long term maintenance of the slurry while waiting to be used by reducing heat gain from the ambient.)
2. Remove the blender container and slurry conditioning-agitator mechanical mechanism 106 from the refrigerator and place on the blender drive motor housing as indicated at block 202.
3. As indicated at a block 204, connect one end of the slurry delivery silicone pump tube 110 to the port on the side of the blender container 116 and route the pump tube through the peristaltic pump. Attach a catheter or other specific slurry delivery injector tip 114 to the discharge end of the pump tube. Make sure the roller mechanism of the pump 112 is engaged to ensure that ingredients to be added to the blender do not drain out through the pump tube.
4. As indicated at a block 206, with the blender power switch turned off, set the blender 102 to a predefined setting involving maximum cutting speed, preferably ~20,000 rpm or greater.
5. As indicated at block 206, the variac % control setting is at 0% and then turn on the variac power switch. As described above, the variac 104 is used to appropriately set the speed of the ice chopping blades for the two stage process of making the slurry: ice chopping is performed with the variac first set at 100% for 45 seconds and then reduced to the 50% setting for slurry conditioning and mixing during pumped delivery.
6. Also as indicated at block 206, start recording temperatures of blender container thermocouples 118, for example, on a Fluke data logger (not shown).
7. With blender 102, Variac 104, and pump tubing 110 hooked up, slurry production is initiated by removing the thermally conditioned saline solution module 120 from the refrigerator and adding it to the blender 102 which is then followed immediately by adding the sterile module 120 of ice chunks taken out of the freezer to the blender and by putting the slurry conditioning-agitator mechanical mechanism 106 and the blender cover 108 assembly in place as indicated at a block 208.
8. At this point ice chopping is immediately started to avoid melting ice by the saline without having chopped the ice by turning the variac % power controller from 0% to 100%, as indicated at block 208. If activation of the blender takes more than few seconds the chemical smoothing is partially wasted and not available to smooth the chopped small ice particles, which significantly degrades the fluidity/handling characteristics of the slurry.

9. As indicated at a block 210, after raising the variac 104 power setting to 100%, immediately initiate the slurry conditioning-agitator mechanical mechanism and time the chopping process for 45 seconds then immediately reduce the variac setting to 50% which stops the ice chopping and initiates the slurry conditioning/mixing phase. Make sure the conditioning-agitator mechanical mechanism undergoes full up and down motion and each cycle is directed sequentially around all 4 quadrants of the blender container. This ensures all ice is pushed repeatedly down into the cutting blade zone.
10. Start pumping the slurry with the peristaltic pump at the desired delivery rate once the variac setting is reduced to 50%, for example, with slurry being pumped into an 8 Fr catheter, as indicated at a block 212. The desired delivery rate depends on the specific medical cooling application and on the desired rate of patient cooling to the desired protective temperature.
11. As indicated at a block 214, when slurry delivery is interrupted for an extended period of time (>5 minutes), the pump and the blender mixer should be turned off to minimize slurry degradation from melting resulting from mechanical dissipation and heat generation. When restarting slurry delivery, the slurry conditioning-agitator mechanical mechanism 106 should be operated for 15 sec to facilitate start up of mixing by the blender.

Methods Developed For Tracking Slurry Ice Loading

Three methods were developed for tracking slurry ice loading during production and delivery:

1. Calorimetery
2. Chemical/mechanical dissipation and blender heat capacitance model
3. Slurry mixture temperature-salinity model All three methods are described below. The method found to be most amenable for integrating into the slurry production and delivery process is 3.) Because of its simplicity and ability to provide real time information on slurry ice loading. The calorimetery method is the most involved and most basic approach and it was used initially as the reference for comparing results from the other two methods as they were developed and validated. In the following, experimental results for all three methods are presented and compared for multiple batches of slurry production using the reference recipe for making blender based ice slurry.

Method 1: Calorimetery

The Calorimeter is used to determine the % ice loading of the slurry at a given time during the slurry production or delivery process by drawing a known mass of slurry from the blender and adding it to the heavily insulated calorimeter container, which also contains a known mass of water at a known initial temperature. The calorimeter cup is comprised of two 16-ounce Styrofoam cups one inside the other with the outside of the cup additionally wrapped in a third ¼ inch thick layer of foam insulation. The cup is covered by a tight fitting insulated lid with includes a penetration for insertion of a fast response thermocouple. The thermocouple is located in the center of the lid and extends into the cup so that when the lid is placed on the cup the tip of the thermocouple lies in the center of the cup at ~3 cm from the bottom. The mass of the ingredients added to calorimeter are determined by a scale and the temperature of the initial water in the calorimeter and the contents after the slurry is added and has melted are determined by the thermocouple located in the calorimeter. Applying the principle of energy conservation to the calorimeter contents allows calculating the % ice loading of the sampled slurry. This principle states that the energy required to melt a given amount of ice in a slurry mixture of ice and water, which is provided by the warmer water initially placed in the calorimeter before adding the slurry, manifests itself as a decrease in the temperature of the final water in the cup after the slurry melts.

The variables and equations used for calculation of % ice loading (Mi) from the calorimeter measurements are:

Variables

Mw=mass of water initially placed in calorimetry cup (grams)

Mf=final mass of water in calorimetry cup after all ice has melted (grams)

Tw=temperature of water initially placed in calorimetry cup (Celsius)

Ts=temperature of the ice slurry sample when collected (Celsius)

Tf=final temperature of water in calorimetry cup after all ice has melted (Celsius)

Ms=mass of slurry sample=Mf−Mw (grams)

Msw=mass of water in slurry sample

Cpw=specific heat of water=1.00 (cal/(gram*C))

Cpi=specific heat of ice=0.50 (cal/(gram*C))

λ=heat of fusion of water=80 (cal/gram)

When a sample of slurry having a measured temperature Ts, (which because of the salt induced freezing point depressions is <0° C.), is placed in the calorimeter, the sample first warms to 0° C. When the sample reaches 0° C., the ice in the sample undergoes a change in state from solid to liquid, which requires additional energy; the heat of fusion of water, λ. The slurry sample, which is now all water, is then warmed from 0° C. to the final recorded calorimeter mixture equilibrium temperature (Tf). Thus the energy required to melt and warm the slurry sample to the final mixture temperature comes from the initial water present in the calorimeter before the slurry was added; assuming negligible heat capacitance of the calorimeter and heat gain from the ambient. Applying energy conservation to this process and solving the resulting equation yields the following equation for Mi, the mass of ice in the slurry sample drawn from the blender:

$$Mi=-[Mw(Tf-Tw)+Ms(Tf-Ts)]/[80+(Ts/2)],$$

From which the percent slurry ice loading by weight=Mi/Ms*100%.

Method 2: Chemical/Mechanical Dissipation and Blender Heat Capacitance Model

The Method for determining the % ice loading of the blender produced slurry is based on modeling three phenomena: 2.1 the ice melted from the chemical smoothing, which is produced by the salt in the saline solution, 2.2 the mechanical dissipation heat generation resulting from the rotating blender blades during ice chopping and slurry mixing/conditioning, and 2.3 ice melted by placing the slurry in a warmer blender. Subtracting these three predictions of melted ice from the original quantity of ice added to the blender yields the % ice loading of the produced slurry. The input data needed for this predictive model of % ice loading are:

a) Slurry ingredients (mass): ice; saline solution and salt concentration;

b) Initial Temperatures: ice; saline solution; blender container; slurry conditioning-agitator mechanical mechanism 106;

c) Mass of blender container;

d) Variac settings (ice chopping and mixing/conditioning) and time at each setting;

e) Experimentally determined mechanical dissipation factors for the blender.

2.1 Melted Ice Due To Chemical Smoothing

Predicting the quantity of ice melted due to the presence of salt in the saline solution when the two ingredients are initially combined in the blender (before starting ice chopping) is based on the fact that the mixture has a unique depressed equilibrium temperature. The relationship between the mixture depressed temperature and the salinity of the saline solution comprising the mixture is found in the reference Concentrative Properties of Aqueous Solutions: Conversion Table by A. V. Wolf, Mordon G. Brown, and Phoebe G. Prentiss in the CRC Handbook of Chemistry and Physics (editors: R. C. Weast and M. J. Astle) on pages D-253-254. The curve fit equation for the freezing point depression temperature $\Delta T_{fp}$ data from the reference versus the percent salinity of the saline solution, X, is given by the equation:

$$\Delta T_{fp}(^\circ\text{ C.})=-(0.6067X-0.0167)$$

The calculated ice melted from chemical smoothing of the ice is based on the difference between the initial temperature of the ice and saline solution and the depressed equilibrium temperature based on the salinity of the slurry mixture. The salinity of the slurry mixture at the moment the ingredients are combined in the blender is given by:

$$X=[\text{mass salt}/(\text{mass salt}+\text{mass water})]*100.$$

The lowering of the freezing point temperature by the suppression effect of the salt on the ice and saline mixture when the ingredients are added to the blender from their initial temperatures when coming out of the two zone refrigeration unit means that the ice and water in the blender container will cool from their initial temperatures and release energy to the slurry which melts ice and smoothes the surfaces of the ice particles.

The following derived equation allows calculation of the ice melted, $\Delta M_I$, due to the salt induced freezing point depression of the mixture, which manifests itself in smoothing the ice particles. The left hand side of the equation represents the thermal energy of the slurry recipe ingredients when first added to the blender and the right hand side represents the energy of the ingredients after the salt in the recipe has depressed the temperature of ingredients and melted some ice. Both sides are equal because of energy conservation and neglecting the heat capacitance of the container and heat gain from the ambient.

$$M_{OI}C_{pI}T_{OI}+M_{OH2O}Cp_{OH2O}T_{OH2O}+M_{OI}\lambda=M_{fI}C_{pI}T_{fI}+M_{fH2O}Cp_{H2O}T_{fH2O}+M_{fI}\lambda.$$

Where the variables in the above equation are: T (temperature of a constituent), M (mass of a constituent), Cp [specific heat; ice (0.5 cal/g° C.); water (1.0 cal/g° C.)], A [heat of fusion; water (80 cal/g)].

The subscripts represent: I (ice), $H_2O$ (water), o (original state before combining ingredients), f (final state after combining ingredients).

Supplemental equations to the above are: change in mass of ice due to chemical smoothing/ice melting, $$\Delta M_I=M_{OI}-M_{fI}=M_{fH2O}-M_{OH2O}$$

mixture in the final state is assumed to be thoroughly mixed and equals the freezing point depression temperature for an ice/saline mixture, thus:

$$T_{fI}=T_{fH2O}=\Delta T_{fp}(^\circ\text{ C.})=-(0.6067X-0.0167)$$

Solving the above conservation equation for $\Delta M_I$ yields the following equation for calculating the ice melted resulting from combing the ingredients in the blender and chemical smoothing:

$$\Delta M_I=[M_{OH2O}Cp_{H2O}(\Delta T_{fp}-T_{OH2O})+M_{OI}C_{pI}(\Delta T_{fp}-T_{OI})]/[(\lambda+C_{pI}\Delta T_{fp}-Cp_{H2O}\Delta T_{fp})]$$

The following example is provided to illustrate the magnitude of ice melting $\Delta M_I$ from chemical smoothing for the standard slurry ingredients recipe of 1800 g ice+1200 g pure $H_2O$+45 g salt which yields a salinity of X=3.61% and a freezing point depression of $\Delta T_{fp}=-2.17°$ C. In addition it is assumed that the both the saline and ice chunks come out of the thermal conditioning freezer/refrigerator with $T_{OH2O}=T_{OI}=0°$ C. For the previous conditions $\Delta M_I=56.2$ g. This is only a small % of the original 1800 g added to the blender but the smoothing only requires that the micro-scale surface roughness of chopped ice particles be melted to get the desired favorable improvement in slurry handling characteristics. It should be noted that based on the equation for $\Delta M_I$ that if for example the saline solution had not been pre-chilled to 0° C. but to only 10° C. there would have been a significant increase in ice melted (from cooling the saline). This illustrates the fact that ice slurry smoothing can be accomplished using both methods; chemical and thermal. However smoothing by melting beyond what is needed reduces the cooling capacity of the delivered slurry.

2.2 Melted Ice Due To Blender Mechanical Dissipation:

This factor involves mechanical energy dissipated from the blender blades during the ice chopping and slurry conditioning phases of slurry production, which is directly added as heat to the slurry and melts ice.

Blender mechanical energy dissipation data was generated by Argonne by performing a series of blender experiments which characterized the amount of energy dissipated by the cutting-blades running at a various variac settings which was expressed as corresponding dissipation factors or the heat which melts ice in the slurry (see Table below). This Table is valid quantitatively for the specific blender employed in these representative development experiments and illustrates qualitatively the trends for other types of blenders. The experiments to calculate the energy dissipation factors for various variac setting were conducted using water only. Since the blender blades during slurry production chop ice particles, there is an additional drag force on the blender blades as well as additional frictional forces within the slurry, which cause additional mechanical energy dissipation beyond those shown in the Table below.

In actual slurry production experiments, it was found that the actual dissipation factors were approximately twice those in the below Table. The reference protocol for making slurry uses the 100% and 50% variac settings. It is seen that much less mechanical dissipation heating (ice melting) occurs at the 50% setting, which is the conditioning/mixing stage of slurry production as compared to the 100% setting, which is the ice chopping stage that only lasts 45 sec.

Comparing ice loading using these dissipation factors to the calorimetry values obtained in numerous experiments has shown that twice the dissipation factor value (×2) provides a more accurate representation of % ice loading.

TABLE

Blender Rheostat Variac Settings & Corresponding Mechanical Dissipation Factors Obtained Through Experimentation

| Variac Setting | Dissipation Factor (cal/min) |
|---|---|
| 100% | 9725.06 |
| 80% | 5590.8 |
| 70% | 4350.0 |
| 60% | 2825.4 |

TABLE-continued

| Blender Rheostat Variac Settings & Corresponding Mechanical Dissipation Factors Obtained Through Experimentation | |
|---|---|
| Variac Setting | Dissipation Factor (cal/min) |
| 50% | 1570.8 |
| 30% | 310.8 |
| 0% | 215.4 |

The mechanical dissipation energy released $E_{mde}$ to the slurry during the ice chopping or conditioning/mixing stages of slurry production by mechanical dissipation is calculated using the appropriate dissipation factor in the above Table (×2) and length of operation time at a given variac setting by:

$$E_{mde}(\text{cal})=\text{Dissipation Factor}(\text{cal/min})*\text{Time at Variac Setting}(\text{min})$$

The mass of ice melted $M_{mde}$ by mechanical dissipation $E_{mde}$ can then be calculated by dividing this quantity by the heat of fusion of ice λ=80 (cal/g):

$$M_{mde}(\text{g})=E_{mde}/80(\text{cal/g})$$

2.3 Melted Ice Due to Blender Heat Capacitance:

This factor involves cooling the blender container down to the freezing point depression temperature. However, this modeling of % ice loading losses takes into account only the upfront heat gain from the thermal capacitance of the blender container assuming the blender container is well insulated from the ambient. For long term operation of the ice slurry coolant production and delivery apparatus, heat gain from the ambient would lead to additional melting of ice.

The stainless steel blender container of mass $M_b$ and the slurry quickly reach an equilibrium temperature given by the freezing point depression temperature $\Delta T_{fp}$. The blender is cooled from its initial temperature $T_b$ resulting in energy released into the slurry $E_b$ which is given by:

$$E_b(\text{cal})=M_b(\text{g})*Cpss(\text{cal/g}^\circ\text{ C.})*(T_b-\Delta T_{fp})$$

It is assumed that all this energy melts ice. The heat of fusion of ice (80 cal/g) is used to calculate the grams of ice melted $M_b$ due to cooling of the blender container by $E_b$.

$$M_b=E_b/80\text{ cal/g}$$

Thus the total amount of ice melted $M_t$ by all three mechanisms: 1) chemical smoothing, $\Delta M_l$, 2) mechanical dissipation, $M_{mde}$, and 3) thermal capacitance of blender, $M_b$ is then given by:

$$M_t(\text{g})=[\Delta M_l+M_{mde}+M_b]$$

Method 3: Temperature and Salinity

The slurry mixture temperature and salinity method is the third method developed to calculate the % ice loading of the slurry. The method is the simplest and easiest method to implement. The method is based on the fact, as described above, that the equilibrium temperature $\Delta T_{fp}$ of a mixture of ice chunks and saline solution is unique function of the % salinity X of the saline solution as represented by the following equation:

$$X=-(\Delta T_{fp}-0.0167)/0.6067$$

Knowing at an instant of time only the temperature $\Delta T_{fp}$ of the well mixed slurry one uses the preceding equation to calculate the % salinity X of the slurry. Since the amount of salt in the blender container is for the specific ingredients recipe used (our reference recipe uses 45 g of salt in 1200 g of water) and does not change during the production or delivery process from the initial 45 grams, knowing X from the salinity equation allows calculation of the amount of water in the blender container $M_{H2O}$ at the given instant of time which is given by:

$$M_{H2O}=(45\text{ g}/X)-45$$

The additional amount of water in the blender container beyond the initial 1200 grams of the initial water added is due to ice melting. Thus, the mass of ice melted during slurry production $\Delta M_I$ at a specific instant of time is equal to the increase in the amount of water in the blender container and is given by:

$$\Delta M_l=M_{H2O}-M_{OH2O}$$

The total ice remaining in the slurry contained in the blender container is calculated by subtracting the amount of ice melted $\Delta M_l$ from the initial amount of ice added to the blender $M_{Ol}$ which for the reference recipe=1800 g.

Experiments Conducted to Quantify Slurry Production Performance

The experimental results for slurry production using the protocols, reference recipe ingredients and equipment described previously are presented for three replications of blender slurry production. The three replications illustrate reproducibility of the slurry % ice loading from batch to batch and also allow comparing results from the three methods for evaluating slurry % ice loading.

Of the three sources of ice chunks explored during equipment development/integration: crushed ice, rectangular cubed ice and ½ sphere ice, the rectangular cubed ice was used for all three experiments because this form of ice was deemed the easiest to produce and implement commercially in the form of sterile modules and transfer to the blender.

In summary, the parameters and conditions used for all three slurry production experiments are:

1) 1800 grams of rectangular ice cubes were made as described above and stored/thermally preconditioned at nominally 0° C.
2) 1245 grams of saline solution (comprised of 1200 g water plus 45 g of salt), blender container, and slurry conditioning-agitator mechanical mechanism 106 were pre-chilled in the refrigerator to nominally 0° C. for each experiment.
3) Two thermocouples located on the slurry conditioning-agitator mechanical mechanism 106 were used to record bulk slurry temperature during the experiment. A third unmounted fast response thermocouple was also used to measure bulk slurry temperature as a check on temperature. Measurement.
4) The slurry conditioning-agitator mechanical mechanism was used throughout the experiment except when momentarily stopped to take the temperature of slurry using the third independent fast response thermocouple and to obtain a small sample of slurry for calorimeter measurement which was used to check on the validity of the two Argonne methods developed for determining slurry ice loading.

Results from the three slurry production experiments are presented in Tables A and B below. Table A shows for the three experiments the temperature of refrigerator thermally pre-conditioned saline just before adding to the blender container. Similarly the ice chunks were made and pre-conditioned and were added to the blender container immediately after adding the saline.

TABLE A

| Temperature of Refrigerator Thermally Pre-Conditioned Saline Just Before Adding To Blender | |
|---|---|
| Experiment # | Saline Temp (C.) |
| 1 | 0 |
| 2 | 1.8 |
| 3 | 1.2 |

Table B shows the temperature of the three batches of slurry in the blender container immediately after completing the 45 sec ice chopping stage of production and the slurry % ice loading by wgt. for the three experiments as determined by the three Argonne developed methods described above. The calorimeter determined % ice loading data is presented for two methods of blender slurry sampling: samples taken directly from the blender container by scooping and samples taken from the pumped delivery of slurry through the silicone tube connected to the blender container.

TABLE B

| Measured Slurry Temperature in Blender and Slurry Ice Loading Determined by Three Argonne Methods | | | | | |
|---|---|---|---|---|---|
| | Slurry | Slurry Ice loading (% by wgt.) by Three Argonne Methods | | | |
| Exp. # | Temp. (C) | Chem./Mech. Dissipation | Temp./ Salinity | Calorimeter Blender | Calorimeter Pumped |
| 1 | −1.7 | 46.2 | 48.5 | 44.1 | 42.9 |
| 2 | −1.6 | 45.0 | 45.2 | 50.9* | 43.7 |
| 3 | −1.6 | 44.7 | 45.2 | 46.7 | 40.0 |

*Believed to be high because of inadequate mixing of the slurry contained in the blender just prior to sampling for the calorimeter. Inadequate mixing allows the buoyant ice particles to float upward becoming denser at the top of the blender container where the sample was taken.

Summary of Experimental Results for Reference Slurry Recipe and Test Equipment Protocol The new integrated operation blender based slurry production equipment exhibits greatly improved performance, reliability, ease of use, and significantly increased ice loading and as a consequence increased cooling ability over that achievable with the previous equipment. Furthermore, the enhanced integrated system makes a 3 liter batch of highly loaded slurry in less than 2 minutes. Additionally, the previous equipment involved separate stages of production requiring considerable operator intervention, which complicated maintaining slurry sterility. The new equipment also has a method for easily monitoring the % ice loading of the slurry coolant during production and delivery.

All three batches of slurry made with the same equipment under identical testing protocols with the same initial ingredients yielded slurry of consistent characteristics of nominally the same % ice loading and handling characteristics. The nominal % ice loading is 45% with only small variation between batches as determined by the three different Argonne methods. It should also be noted that Table B data under the calorimeter heading does suggest that the pumping process and heat gain through the silicone pump tube may be degrading the slurry ice loading by a few % from the slurry sampled directly from the blender container. This behavior may also be a result of not waiting for the pump and tubing to cool down enough before delivering the slurry to the calorimeter. The temperature/salinity approach to determining % ice loading, from the viewpoint of implementation into a commercial medical device, because of its simplicity is the preferred method. This method through the use of a built-in process control module/computer could very easily be used to generate a visual display of ice loading during the entire slurry production and delivery stages.

Additional Argonne Ice Slurry Equipment Enhancements

Additional improvements which are described below are directed, for example, at getting the equipment ready for possible clinical trials and enable broadening medical applications of slurry cooling.

1. Further Reduction of Ice Slurry Entrained Air and Intentionally Adding Micro-bubbles of Therapeutic Gases With our new integrated-operation ice slurry production system 100, we have also reduced the entrained air content significantly of the delivered slurry compared to the past multi-step equipment. In the past equipment, air was being introduced during the slurry production by intense mixing and the vortex produced by the blender blades; with air content as a percent of slurry delivered being on order of 7% by volume. The slurry air content is not very important in applications involving cooling via the lungs or stomach delivery of slurry or in organ cooling via external slurry application during procedures like laparoscopic kidney surgery. However, air is of concern when using IV delivery because of its potential for inducing an embolism. In the new system by using a single container and leaving the slurry conditioning-agitator mechanical mechanism in place after chopping the ice and turning the blender to a much lower speed we have reduced air entrainment at the slurry-air interface and have blocked the formation of an air entraining vortex formed in the blender container. It should also be noted that the mixing in the new system is from the bottom resulting is much more uniform mixing, whereas in the previous system involving multiple separate steps and intermediate transfer of slurry to another container the mixing was from the top and contributed greatly to entraining air. These changes have reduced air content to <2%. We are pursuing additional ways to further reduce air entrainment, which involves putting a gas liquid separator in the slurry delivery tube.

Argonne also realizes that it maybe advantageous under certain IV cooling scenarios to intentionally incorporate therapeutic gases such as oxygen into the slurry in a controlled manner during slurry deliver. Argonne is developing a method to accomplish controlled gas delivery with the slurry, which uses porous ceramic frits for adding gases into the blender container during production, or where more controlled delivery of a gas is required by injecting it directly into the slurry delivery tube.

2) Real time knowledge of % ice loading during slurry delivery through the use of a process monitor computer module is being implemented to generate a visual display of ice loading during the entire slurry production and delivery stages allowing doctors to see the cooling capacity of the slurry being delivered and how much slurry remains in the blender container.

Argonne is also developing more robust and improved placement of thermocouples in the harsh blender container environment for monitoring slurry temperature, which is used to determine slurry % ice loading using the temperature/salinity we have developed.

3) Pressure and Temperature Feed Back Control Safety Features

Argonne is developing feedback control and slurry equipment safety features, which involve monitoring slurry supply pressure and target organ temperature. Feed back control based on target temperature will allow controlling the amount of slurry delivered and the rate consistent with reaching and maintaining a target temperature. Feed back control based on slurry delivery pressure will also allow shut down of delivery if back pressure rises above a tissue damaging level preventing over-pressurization of organs or bio-fluid conduits. Feed back control can also be used to shutdown the blender mixing for extended time periods when slurry is not needed in order to conserve slurry ice loading by eliminating mechanical dissipation from the mixing process. Also active cooling of the blender container may be added with computer controlled feedback for minimizing heat gain from the ambient to ensure long term slurry stability.

4) Argonne is also developing additional features into the slurry production and delivery equipment for delivering slurry using multiple routes (multiple streams) of administration; for example through IV femoral vein injection for initial rapid cool down and then via stomach cooling for long term maintenance at target temperature.

5) Argonne is also developing slurries produced with different carrier liquids and additional therapeutic chemicals and gases to further expand the attributes and applications of ice slurry cooling. For example, Argonne has made slurry in the new system using a commercially available blood substitute as the carrier liquid for the slurry ice particles.

While the present invention has been described with reference to the details of the embodiments of the invention shown in the drawing, these details are not intended to limit the scope of the invention as claimed in the appended claims.

What is claimed is:

1. An apparatus for the preparation and delivery of sterile medical ice slurry comprising:

a blender for receiving a plurality of sterile slurry ingredient modules, said plurality of sterile slurry ingredient modules respectively containing a first predefined quantity of thermally conditioned sterile saline solution carrier liquid and a second predefined quantity of chunk ice;

said blender including a thermally insulating blender container, a cutter blade contained within said thermally insulating blender container, and a blender cover;

a blender outlet port disposed in a lower portion of said blender container;

a slurry conditioning-agitator mechanical mechanism coupled to said blender cover; said slurry conditioning-agitator mechanical mechanism being positioned directly on a central vertical axis of said thermally insulating blender container and extending downwardly toward said cutter blade within said thermally insulating blender container, said slurry conditioning-agitator mechanical mechanism being moved up and down within the blender container to enhance mixing by substantially eliminating cavitations around the cutter blade, and controlling air entrainment in the sterile medical ice slurry by suppressing formation of an air entraining vortex in said thermally insulating blender container;

said cutter blade being positioned at the bottom of the thermally insulating blender container;

a slurry delivery tubing pump coupled to said blender outlet port by a slurry delivery pump tube;

an associated injector tip connected to a discharge end of said slurry delivery pump tube, said associated injector tip being selected for a particular medical cooling application;

a variable electric power transformer coupled to said blender controlling blender speed and precisely timed blender operation; and at least one thermocouple mounted inside said blender container for recording temperature.

2. The apparatus for the preparation and delivery of sterile medical ice slurry as recited in claim 1 wherein said variable electric power transformer controls blender cycle blender operation through precisely timed first and second stages of slurry production.

3. The apparatus for the preparation and delivery of sterile medical ice slurry as recited in claim 1 wherein said plurality of sterile slurry ingredient modules includes a approximately 1200 grams of sterile saline carrier liquid containing approximately 45 grams of NaCl (salt).

4. The apparatus for the preparation and delivery of sterile medical ice slurry as recited in claim 1 wherein said plurality of sterile slurry ingredient modules includes a approximately 1800 grams of sterile chunk ice.

5. The apparatus for the preparation and delivery of sterile medical ice slurry as recited in claim 1 includes a refrigeration unit for preconditioning said plurality of sterile slurry ingredient modules.

6. The apparatus for the preparation and delivery of sterile medical ice slurry as recited in claim 1 wherein said cutter blade of said blender includes motor driven blender blades and said variable electric power transformer controls said blender blades for a precisely timed first ice chopping stage and a second slurry conditioning and mixing stage; and wherein speed of said blender blades being substantially lower during said second slurry conditioning and mixing stage than during said precisely timed first ice chopping stage.

7. The apparatus for the preparation and delivery of sterile medical ice slurry as recited in claim 6 wherein said slurry conditioning-agitator mechanical mechanism is moved up and down during said first ice chopping stage and wherein a duration of said precisely timed first ice chopping stage is limited for optimal use of salt in a sterile carrier liquid for smoothing ice particles.

8. The apparatus for the preparation and delivery of sterile medical ice slurry as recited in claim 1 wherein slurry temperature data measured by said at least one thermocouple is used for quantifying % ice loading of the ice slurry during production and delivery.

9. The apparatus for the preparation and delivery of sterile medical ice slurry as recited in claim 1 includes a two zone preconditioning refrigerator for storing and thermally preconditioning said plurality of sterile slurry ingredient modules.

10. The apparatus for the preparation and delivery of sterile medical ice slurry as recited in claim 1 wherein said slurry delivery tubing pump coupled to said blender outlet port delivers sterile medical ice slurry having ice loadings of greater than approximately 50% and said sterile medical ice slurry being capable of delivery through a medical injector tip without plugging, including very long (>100cm) and small diameter (<5 Fr) catheters for inducing protective cooling for a wide variety of surgical applications.

11. A method for the preparation and delivery of sterile medical ice slurry using an integrated blender preparation and delivery device, said method comprising the steps of:

preparing and cooling a plurality of sterile slurry ingredient modules, said plurality of sterile slurry ingredient modules respectively containing a first predefined quantity of thermally conditioned sterile saline solution carrier liquid and a second predefined quantity of chunk ice;

providing a blender including a thermally insulating blender container, a cutter blade contained within said thermally insulating blender container, a blender cover, a blender outlet port disposed in a lower portion of said blender container;

providing a slurry delivery tubing pump coupled to said blender outlet port by a slurry delivery pump tube, and providing an associated injector tip connected to a discharge end of said slurry delivery pump tube; said associated injector tip being selected for a particular medical cooling application;

providing at least one thermocouple mounted inside said blender container for recording temperature;

providing a slurry conditioning-agitator mechanical mechanism coupled to said blender cover; said slurry conditioning-agitator mechanical mechanism being positioned directly on a central vertical axis of said thermally insulating blender container and extending downwardly toward said cutter blade within said thermally insulating blender container;

wherein said cutter blade is positioned at the bottom of the thermally insulating blender container;

providing a variable electric power transformer coupled to said blender;

operating said variable electric power transformer for controlling blender speed and controlling blender cycle blender operation through a precisely timed first ice chopping stage and a second slurry conditioning and mixing stage; speed of said blender cutter blade being substantially lower during said second slurry conditioning and mixing stage than during said precisely timed first ice chopping stage; and moving said slurry conditioning-agitator mechanical mechanism up and down within the blender container to enhance mixing by substantially eliminating cavitations around the cutter blade, and controlling air entrainment in the sterile medical ice slurry during the first ice chopping stage.

12. The method for the preparation and delivery of sterile medical ice slurry as recited in claim 11 includes cooling said blender cover and said slurry conditioning-agitator mechanical mechanism before use in slurry production.

13. The method for the preparation and delivery of sterile medical ice slurry as recited in claim 11 wherein preparing and cooling said plurality of sterile slurry ingredient modules includes providing a first sterile module including approximately 1200 grams of saline based ice particle carrier liquid with dissolved salt of approximately 45 grams of NaCl (salt) for ice particle chemical smoothing; and refrigerating said first sterile module.

14. The method for the preparation and delivery of sterile medical ice slurry as recited in claim 13 wherein preparing and cooling said plurality of sterile slurry ingredient modules includes providing a second sterile module including freezing sterile water in a sterile tray to form approximately 1800 grams of ice chunks; and storing said ice chunks in a freezer.

15. The method for the preparation and delivery of sterile medical ice slurry as recited in claim 11 includes using slurry temperature data measured by said at least one thermocouple for quantifying % ice loading of the ice slurry during production and delivery.

16. The method for the preparation and delivery of sterile medical ice slurry as recited in claim 11 includes pumping the sterile medical ice slurry using said slurry delivery tubing pump during the second slurry conditioning and mixing stage.

17. The method for the preparation and delivery of sterile medical ice slurry as recited in claim 11 wherein the first ice chopping stage and moving the slurry conditioning-agitator mechanical mechanism is performed for a set time period of approximately 45 seconds.

18. The method for the preparation and delivery of sterile medical ice slurry as recited in claim 11 wherein pumping the sterile medical ice slurry using said slurry delivery tubing pump delivers sterile medical ice slurry having ice loadings of greater than approximately 50%.

* * * * *